US005863085A

United States Patent [19]

Khachaturian

[11] Patent Number: 5,863,085

[45] Date of Patent: Jan. 26, 1999

[54] SPREADER BAR ASSEMBLY

[75] Inventor: Jon E. Khachaturian, New Orleans, La.

[73] Assignee: Versabar, Inc., Belle Chasse, La.

[21] Appl. No.: 710,870

[22] Filed: Sep. 23, 1996

[51] Int. Cl.[6] ..... B66C 1/12

[52] U.S. Cl. ..... 294/81.1; 294/81.5

[58] Field of Search ..... 294/81.1, 81.2, 294/81.21, 81.5, 81.55, 81.56, 82.11, 67.1, 67.4, 67.41, 74

[56] References Cited

U.S. PATENT DOCUMENTS

| | | | |
|---|---|---|---|
| 3,010,751 | 11/1961 | Day et al. | 294/81 |
| 3,206,243 | 9/1965 | Miles | 294/81 |
| 3,252,729 | 5/1966 | Holmes | 294/81 |
| 3,762,756 | 10/1973 | Cole | 294/81 R |
| 4,128,267 | 12/1978 | Niblett et al. | 294/81 R |
| 4,136,903 | 1/1979 | Roethler | 294/81 R |
| 4,215,891 | 8/1980 | Thiele | 294/74 |
| 4,258,949 | 3/1981 | Keagbine | 294/81 SF |
| 4,397,493 | 8/1983 | Khachaturian et al. | 294/81 R |
| 4,538,849 | 9/1985 | Khachaturian et al. | 294/81.1 |
| 5,603,544 | 2/1997 | Bishop et al. | 294/81.1 |

FOREIGN PATENT DOCUMENTS

| | | | |
|---|---|---|---|
| 1532-504 | 12/1989 | U.S.S.R. | 294/81.2 |
| 1101157 | 1/1968 | United Kingdom | 294/81.21 |
| 2059914 | 4/1981 | United Kingdom | 294/81.1 |
| 2161946 | 1/1986 | United Kingdom | 294/81.1 |

*Primary Examiner*—Dean Kramer

*Attorney, Agent, or Firm*—Garvey, Smith, Nehrbass & Doody, L.L.C.

[57] ABSTRACT

A spreader bar assembly includes a rigid elongated support bar to which a pair of end caps are removably connected for use during a lifting operation. The end caps have sockets that fit over the ends of the bar. Each of the end caps includes three pins mounted on a pair of longitudinally extending plates on the extreme end of each of the end caps. A first pin extends between the plates and a pin is mounted externally on each of the plates. The user can attach slings directly to these pins thus eliminating the need for shackles.

6 Claims, 5 Drawing Sheets

SPREADER BAR ASSEMBLY

BACKGROUND OF THE INVENTION

1. Field of the Invention

The present invention relates to multi-ton lifting of marine platforms using spreader bars and like lifting devices. More particularly, the present invention relates to a marine lifting apparatus that utilizes a spreader bar assembly having end portions which can be removably fitted to the end of a section of a cylindrical beam or a like structural member which has been cut to a desired length. Even more particularly the present invention relates to a spreader bar apparatus having a spreader bar and end caps with transverse cylindrical lifting posts that allow direct attachment of slings thereto.

2. General Background

In the lifting of marine platforms, drilling rigs and production platform (such as for loading onto ships or for construction), a derrick normally provides a load line which branches at a bridle and attaches in two places to an elongated lifting bar or frame known in the art as a spreader bar. The spreader bar then has depending load lines lowered from it at each end which are then affixed to a piece of equipment to be lifted. This spreader bar apparatus per se and the use of spreader bars to lift items is generally known in the art.

Very large spreader frames custom constructed to fit a piece of equipment of a given load and dimension, and thus are not reused except on a piece of equipment of similar dimension and equal or lesser load.

Attempts have been made in various United Sates patents to teach a method for providing an adjustable spreader bar that can be used over a variety of spreader lengths. Some spreader bars use removable end caps to which shackles are affixed. The Khachaturian patent 4,397,493 discloses a spreader bar with removable end caps, each having openings to which shackles can be attached.

The use of multiple spreader bars as part of a lifting frame or assembly is discussed in the Khachaturian patent 4,538,849. In the '849 patent, a composite spreader frame assembly provides a primary load line having a bridle attached to the load line and four branching lines connected at one respective end to the bridle. A pair of separate elongated support bars are each supported independently by the alternate radially extending branch lines. A plurality of lifting eyes are removably connected at each respective end of the elongated support bars. Four secondary depending load lines which are generally vertical during lifting are attached at the upper end to the lifting eyes and at the lower end to a load to be lifted.

In U.S. Pat. No. 4,128,267 entitled "Lifting Beam" there can be seen a lifting beam comprising an elongate member carrying one or more pivotally mounted hooks for engagement of a load to be lifted. A balance weight is provided on the hooks to lie on either side of the pivotal axis thereof so as to cause the hook to be biased into or from engagement of the load to picked up or released when the beam is lowered onto same.

In U.S. Pat. No. 4,136,903 there can be seen a "Tire Lifting Apparatus" which comprises a master support sleeve, two moveable arms slidably associated therewith, and two hook units pivotally connected to the arms for easy engagement with the inner rim of a tire.

A "Handling Beam for Heavy Elongate Objects" can be seen in U.S. Pat. No. 3,762,756 which comprises a missile handling beam assembly readily engageable with conventional missile supporting lug arrangements. The assembly does not impose any stress on the object being handled, since a lifting hook can be located in a position closest to the center of gravity of the load, hence the attitude of the object can be easily controlled during the lifting and lowering movements.

In U.S. Pat. No. 4,258,949 entitled "Extensible Spreader Frame for Cargo Containers" there can be seen an extensible lifting spreader frame comprising a pair of oppositely extending beam arms slidably received within a central pair of side-by-side connected sleeve beams. Beam cross arms at the outer ends of the sleeve beams mount twist-lock lock latching hooks at their opposite ends for attachment to the four selected top corners of a cargo container to be lifted.

A "Sling Mounting Head" for use with a spacer element and mouthing two members of a sling chain can be seen in U.S. Pat. No. 4,215,891. The sling mounting head has a body portion including a central section, and first and second end sections extending from the central section.

In U.S. Pat. No. 3,206,243 issued to B. F. Miles on Sep. 14, 1965, there is seen a "Spreader Bar" apparatus.

U.S. Pat. No. 3,010,751 entitled "Adjustable Lift Hooks" issued on Nov. 28, 1961 to E. J. Day et al.

A "Sling Carrier" device is seen in U.S. Pat. No. 3,252,729 which issued on May 24, 1966 to R. A. Holmes.

SUMMARY OF THE INVENTION

The present invention solves these prior art problems and shortcomings in a simple manner by providing a spreader bar assembly which utilizes a rigid elongated central support bar of uniform cross-section such as, for example, an elongated section of pipe that can be precut to a desired length.

A pair of end caps are connected during the lifting operating at respective end portions of the bar to form removable connections with the bar and also with slings that extend above to a supporting bridle line and below to a package to be lifted.

Each of the end caps comprises a socket of uniform cross-section, receptive of one end of the bar. Each end cap has a corresponding internal cross-section to that of the support bar. A stop plate is provided for limiting the degree of penetration of the support bar into the respective socket.

The central support bar can be an elongated section of cylindrical pipe and the sockets are cylindrical, being of an equal or slightly larger internal diameter to the external diameter of the section of pipe.

The sockets are preferably open ended at one end portion and terminate at an inner stop. A pair of plates are affixed rigidly to the socket and extends rearwardly therefrom away from the open end portion of the socket. A transverse pin is provided in between the plates which is receptive of a sling or lifting line. In another embodiment, four plates are provided and multiple pins span respectively between the plates. Slings can be folded around the pins for lifting.

From the above, one skilled in the art will see that the end lifting eye assemblies are freely removable from the pipe and thus could be reused over and over again by the attachment to lengths of pipe of desired precut dimensions.

It is an object of the present invention to provide a spreader bar assembly which can be adapted to a variety of dimensional situations without having to reconstruct the entire bar with each lift.

Another object of the present invention is to provide a spreader bar assembly with removable end lifting portions which could be added to a desired central spreader bar portion of desired dimensions.

Another object of the present invention is to provide a spreader bar assembly which is highly versatile, easy to construct and of high structural integrity.

Another object of the present invention is to provide a spreader bar which is not generally dependent upon a certain required sling length for lift, allowing for a wide variation in sling or bridle lengths.

Another object of the present invention is to provide a spreader bar that has improved removable end caps that are designed to eliminate the need for shackles in many situations.

Yet another object of the present invention is to provide an adjustable spreader bar that has improved removable end caps that allow a single folded sling to attach at transverse pin portions of the end cap.

BRIEF DESCRIPTION OF THE DRAWINGS:

For a further understanding of the nature and objects of the present invention, reference should be had to the following detailed description, taken in conjunction with the accompanying drawings, in which like parts are given like reference numerals, and wherein.

Figures 1, 2:
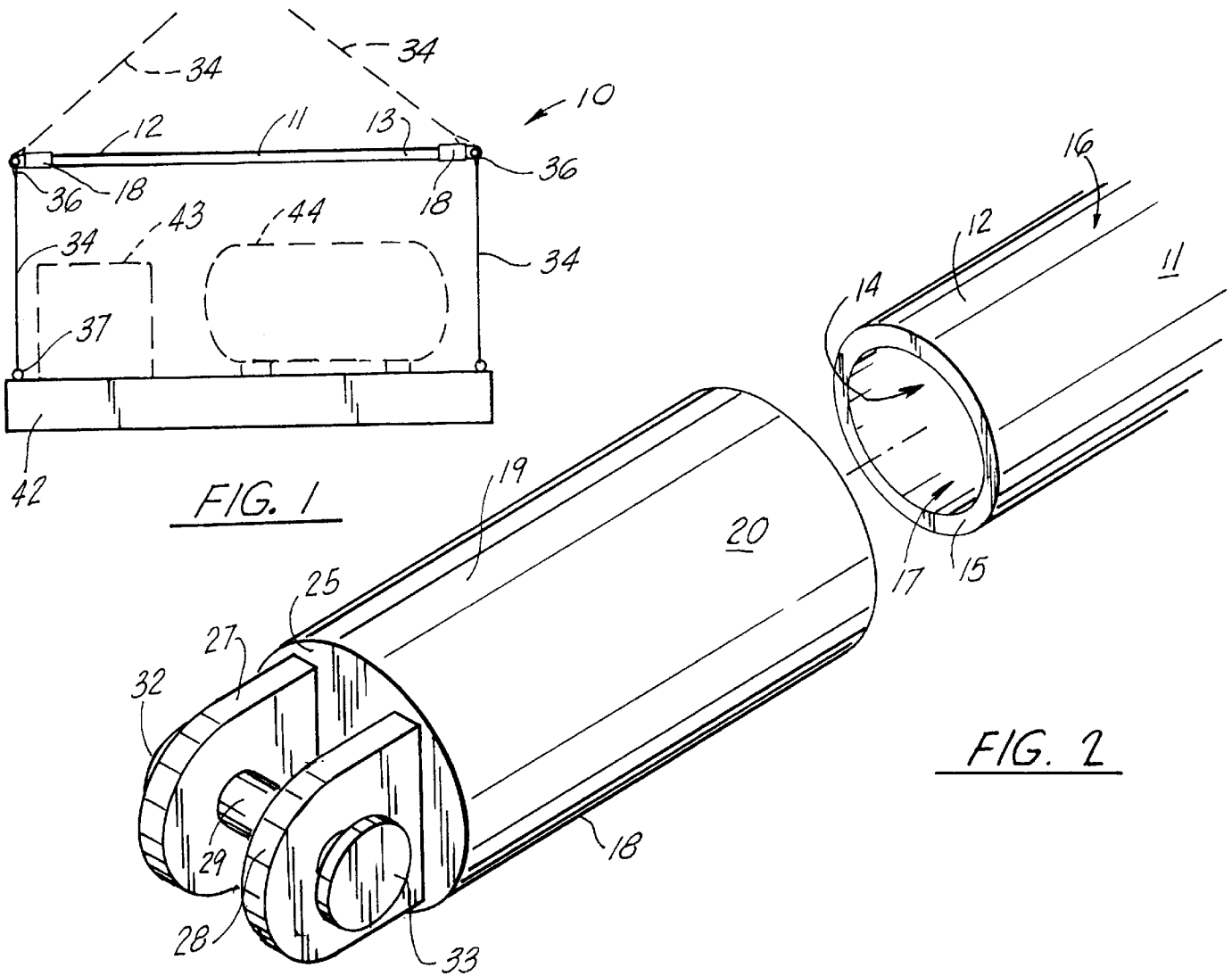
FIG. 1 is a schematic elevational view of the preferred embodiment of the apparatus of the present invention.
FIG. 2 is a partial perspective view of the preferred embodiment of the apparatus of the present invention.
Figure 3:
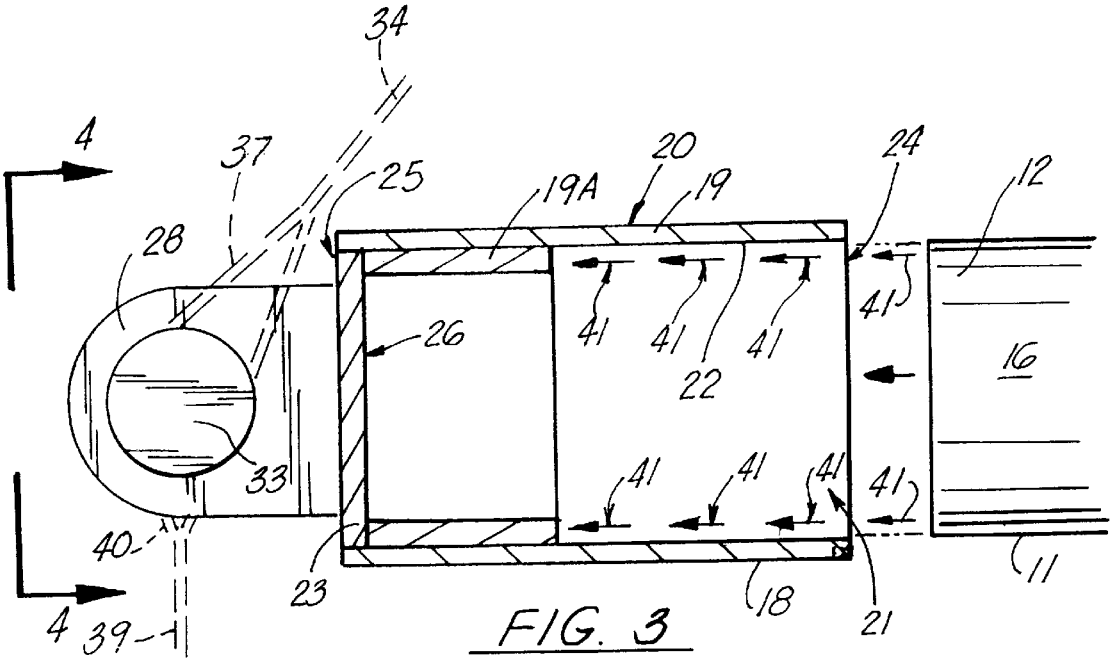
FIG. 3 is a partial sectional elevational view of the preferred embodiment of the apparatus of the present invention.

DETAILED DESCRIPTION OF THE PREFERRED EMBODIMENT:

FIGS. 1–3 show generally the preferred embodiment of the apparatus of the present invention designated by the numeral 10. Spreader bar assembly 10 is comprised of a center bar 11 and a pair of end caps 18. The bar 11 can be a hollow section of pipe with end portions 12, 13, a hollow bore 14, and a cylindrical wall 15. The cylindrical wall 15 has an outer surface 16 and an inner surface 17.

Spreader bar assembly 10 preferably has two identically formed end caps 18 placed at the ends 12, 13 of bar 11. An end cap 18 is shown in more detail in FIGS. 2 and 3. Each end cap 18 is formed of a cylindrical wall portion 19 having an outer surface 20 and an inner surface 22. The end cap 18 thus provides an inner bore 21 that is sized and shaped to receive an end portion 12 or 13 of bar 11. The inner surface 22 of cylindrical wall portion 19 preferably closely conforms to and engages the outer surface 16 of bar 11 at a selected end 12 or 13.

A second cylindrically shaped wall portion 19A is positioned within end cap 19. The cylindrical wall portion 19A is identically sized and shaped to the cylindrical wall 15 of bar 11. Further, an end 12 or 13 of bar 11 engages the cylindrical wall portion 19A as shown by arrows 41 in FIG. 3. Axial load is thus transferred from end cap 18 at wall 19A to an end portion 12, 13 of bar 11 during use. Wall portion 19A is integrally connected to wall 19 by welding for example. Transverse wall 23 is welded or otherwise connected to an end of cylindrical wall 19 forming a closure (see FIG. 3).

Figure 5:
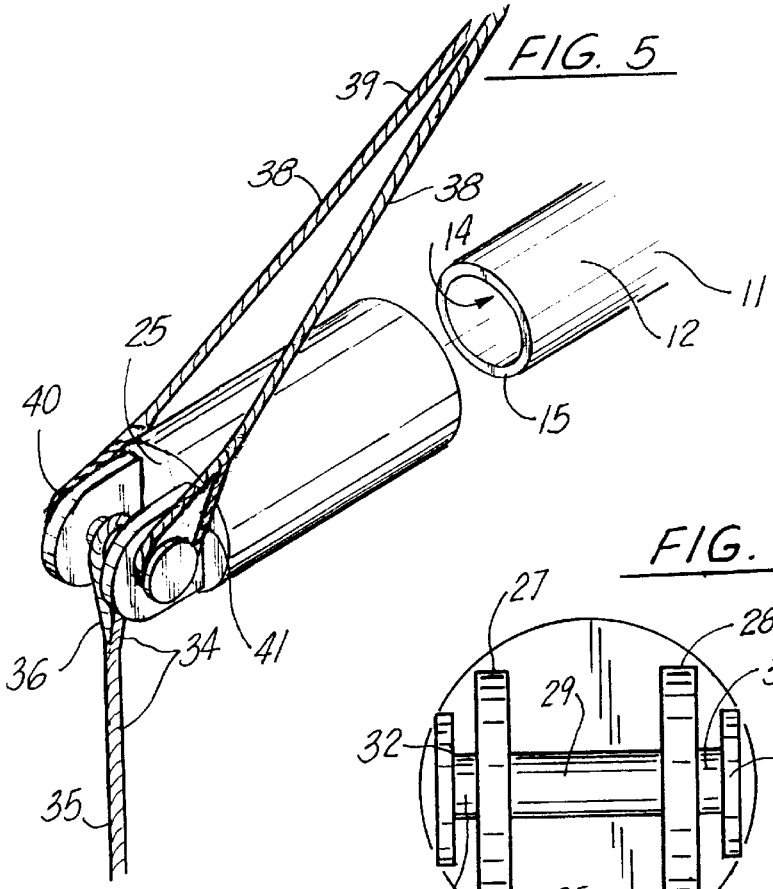
FIG. 5 is a partial perspective exploded view of the preferred embodiment of the apparatus of the present invention.
Figure 4:
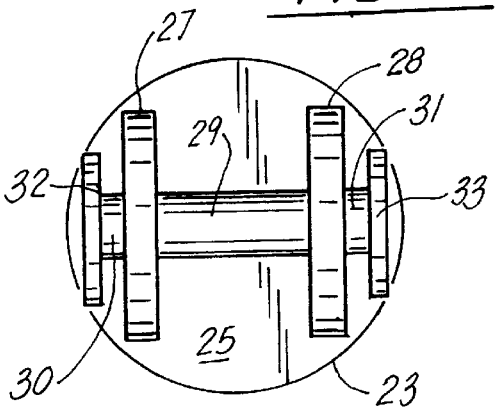
FIG. 4 is a partial end view of the preferred embodiment of the apparatus of the present invention.

The transverse wall 23 has an outer surface 25 and inner surface 26. The inner surface 26 communicates with an end portion of cylindrical wall 19A as shown in FIG. 3. The outer surface 25 carries a pair of longitudinally extending plates 27, 28 that extend longitudinally away from the outer surface 25 of transverse wall 23, being attached thereto by welding for example. The plates 27, 28 are flat, and each forms an angle of about ninety degrees (90°) with transverse wall 23 as shown in FIGS. 3–5.

A first transverse pin 29 extends between plates 27 and 28. There are a pair of other transverse pins 30 and 31 that are mounted respectively to the outside surface of the plates 27 and 28 (see FIG. 4). Each of the external transverse pins 30 and 31 carries a circular retainer plate 32, 33. As shown in FIGS. 2 and 5, a first sling 34 can be attached to transverse pin 29. The sling 34 has a center cable portion 35 and a pair of end portions in the form of loops or eyes 36, 37. One of the eyes 36, 37 can be selected for attachment to transverse pin 29. Another sling 38 has end portions in the form of loops or eyes 40, 41 and a center cable section 39. The sling 38 is folded generally in half as shown in FIGS. 2 and 3, so that a first eye 40 can fit one of the transverse pins 30 or 31 and a second eye or loop 41 fits the other transverse pin 30 or 31. The retainer plates 32, 33 prevent disengagement of the loops 40 or 41 from the selected transverse pins 30 or 31.

In FIG. 1, each sling 34 is attached at one end with loop 36 to an end cap 18. In FIG. 1, a pair of slings 34 are shown attached to the spreader bar apparatus 10 of the present invention. Each of the slings 34 is attached at its upper eyelet 36 to an end cap 18. The lower eyelet 37 forms an attachment with a load 42 to be lifted. The load 42 can be for example an offshore oil and gas production platform or like prefabricated package. These packages can weight many hundreds of tons and be lifted with the apparatus of the present invention. The package 42 thus can include many number of individual items of equipment 43 including for example tanks or storage vessels 44. Thus, package 42 is a broad term as used herein, applying to oil and gas well drilling platforms, oil and gas well production platforms, concrete barges outfitted with oil and gas production equipment, and the like.

Figure 6:
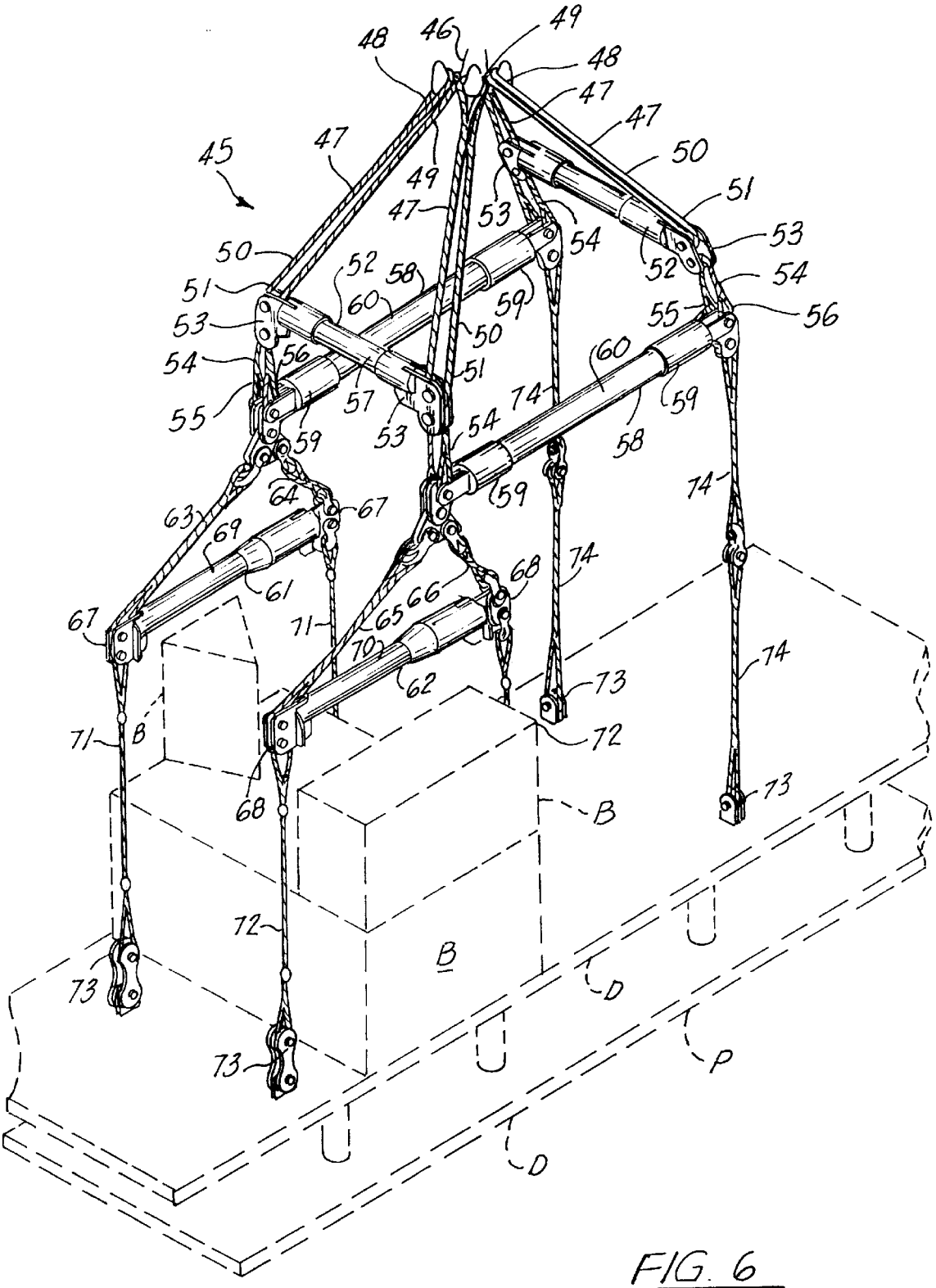
FIG. 6 is an alternative embodiment of the apparatus of the present invention.

FIG. 6 shows an alternative embodiment of the apparatus of the present invention designated generally by the numeral 45. Lifting apparatus 45 shows a hook 46 such as is typically provided with large derrick barges and similar lifting apparatus that can lift hundreds of tons. Hook 46 is shown in FIG. 6 supporting four slings 47. Each sling 47 has a middle portion 50 and a pair of end portions 48, 49 in the form of loops. In FIG. 6, each of the slings 47 is doubled at fold 51. The fold 51 of each sling 47 is connected to the end of spreader bar 52. As shown, one of the spreader bars 52 is attached to a pair of slings 47 that are supported by the hook 46.

Each spreader bar 52 is comprised of an elongated bar section 57 having a pair of end caps 53 mounted at the end portions of the bar section 57. A sling 54 is supported by each end cap 53. The sling 54 is folded in half so that its end portions in the form of loops 55, 56 are positioned away from the end cap 53 as shown in FIG. 6. This allows the loops 55, 56 of each sling 54 to form an attachment to an underlying spreader bar 58 at the end caps 59 of each bar 58.

The two bars 58 shown in FIG. 6 each include end caps 59 to which are attached loops 55, 56 of a sling 54 that is supported from above by an end cap 53. Each spreader bar 58 has a central bar section 60 that is attached at its end portions to the end caps 59.

In FIG. 6, a package P of irregular configuration is shown. Such a package P can be an oil and gas offshore platform, for example. The package P can include a deck D having buildings B or other structures thereon. A pair of spreader bars 61, 62 are positioned above buildings B. The spreader bar 61 is supported by a pair of slings 63, 64. Slings 63, 64 are each supported above by end cap 59. The spreader bar 61 has end caps 67 and a bar section 69. The spreader bar 62 has a bar section 70 with a pair of end caps 68 attached to the bar section 70. The spreader bar 62 is supported by a pair of slings 65, 66 that are supported from above by end cap 59.

The end caps 67, 68 each support a sling that is attached to the deck D. In FIG. 6, end caps 67 and 68 respectively support vertical slings 71 and 72 that are attached to lift fixtures or padeyes 73 mounted on deck D. The deck D may not have buildings B in the region of vertical slings 74 as shown. Thus, the slings 74 extend directly from two of the end caps 59 as shown in FIG. 6 to the deck D.

Figure 7:
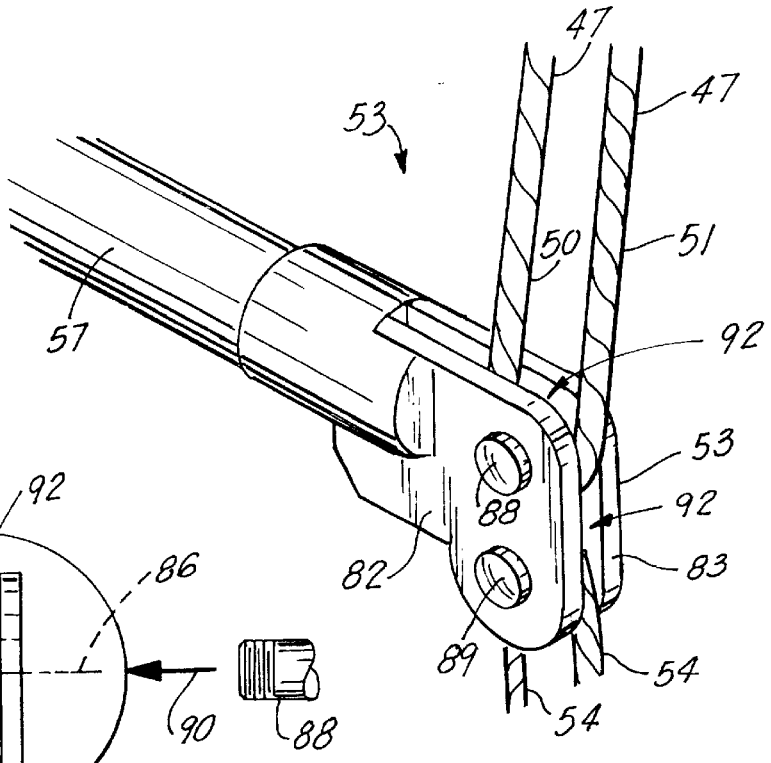
FIG. 7 is a fragmentary perspective view of the alternative embodiment of the apparatus of the present invention.
Figure 8:
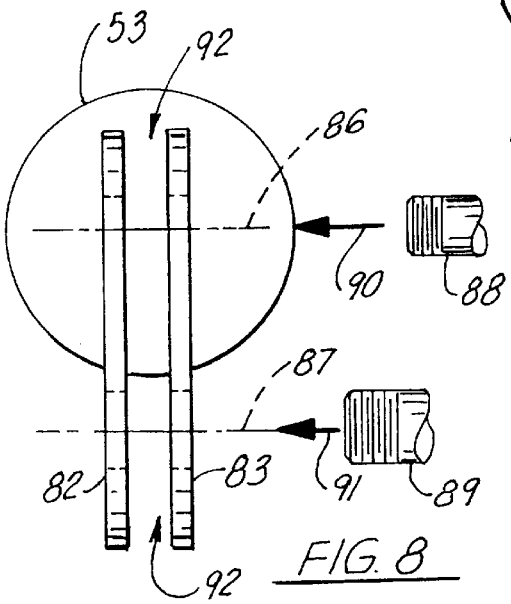
FIG. 8 is a side view of the embodiment of the FIG. 7.
Figure 9:
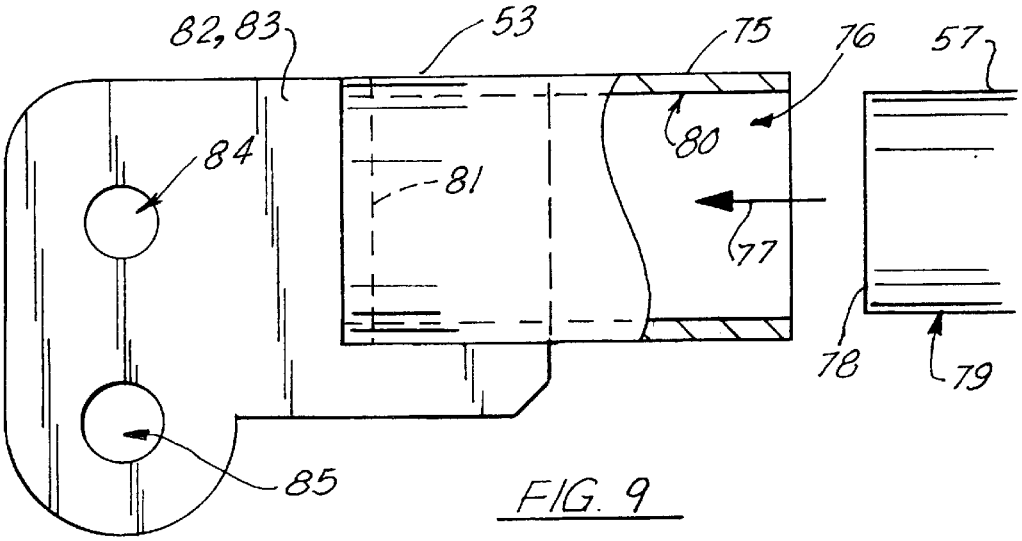
FIG. 9 is a partially sectional elevational view of the embodiment in FIG. 7.

The construction of end cap 53 is shown more clearly in FIGS. 7–9. The construction of end cap 59 is shown more clearly in FIGS. 10–12. FIGS. 7–9 show end cap 53 more particularly. The end cap 53 is shown in FIG. 9 prior to its connection to bar section 57. End cap 53 is comprised of a cylindrical section or cylinder 75 having an open ended socket portion 76 that is also cylindrically shaped as defined by the inside surface 80 of cylinder 75. Arrow 77 schematically illustrates the assembly of bar section 57 into socket 76 of cylinder 75 of end cap 52.

The bar section 57 has an outer surface 79 that is correspondingly shaped to the shape of socket 76 so that a close snug fit is obtained between cylinder 75 and the outer surface 79 of bar section 57. The travel of end portion 59 of bar section 57 into the socket 76 of end cap 53 in the direction of arrow 57 is limited by stop plate 81. Thus, the end 79 of bar 57 engages the plate 81 upon assembly and during lifting.

A pair of spaced apart plates 82, 83 are provided, each of the same configuration as shown in FIGS. 7–9. The plates 82, 83 each provide openings 84, 85. Each of the openings is circular and of the same size and shape. In fact the openings 84, 85 are aligned upon the same axial line 86, 87 as shown in FIG. 8. This allows a cylindrically shaped transverse pin 88, 89 to be placed respectively through the pair of upper openings 84 and the pair of lower openings 85. The transverse pin 88 engages sling 47. The pin 89 engages sling 54. The slings 47 and 54 occupy the space 92 that is in between the plates 82–83 as shown in FIGS. 7 and 8.

Figure 10:
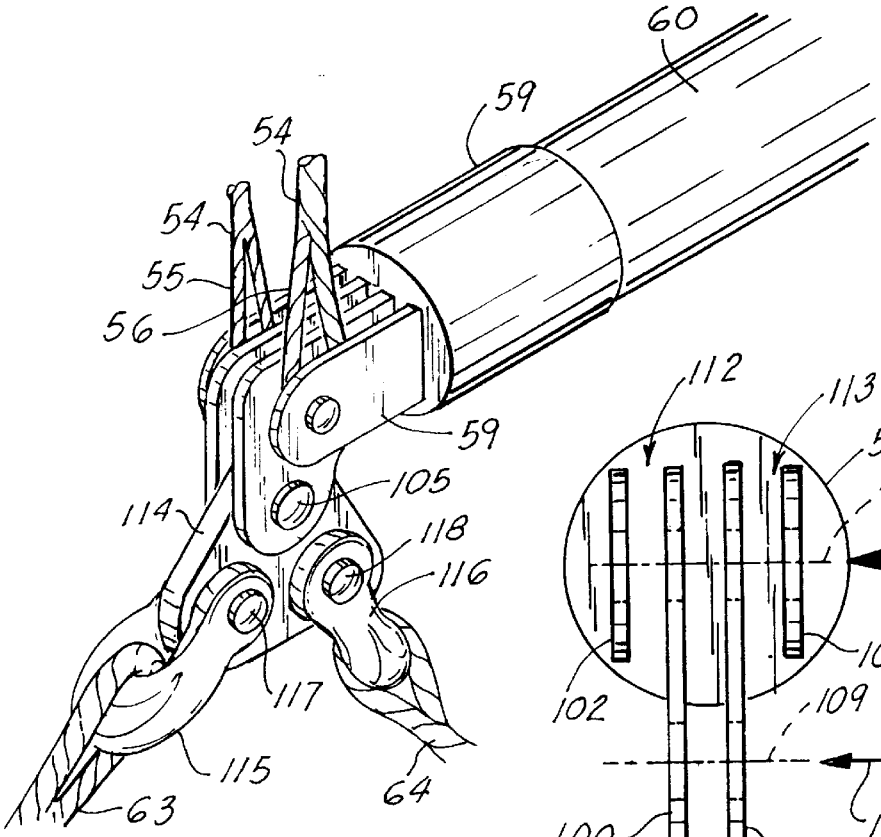
FIG. 10 is a perspective fragmentary view of a second alternate embodiment of the apparatus of the present invention.
Figure 12:
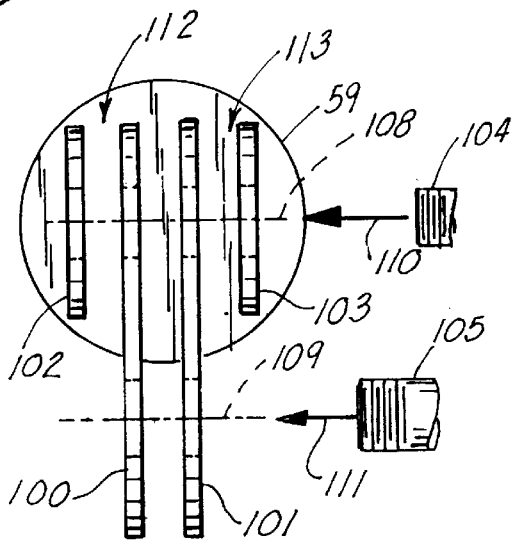
FIG. 12 is a sectional view taken along lines 12—12 of FIG. 11.
Figure 11:
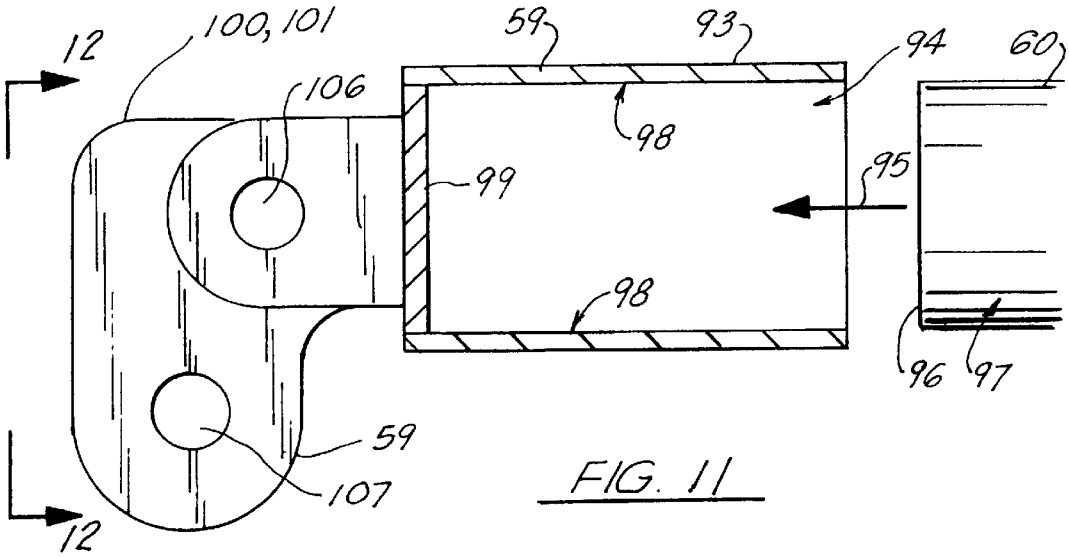
FIG. 11 is a partially sectional elevational view of the embodiment of FIG. 10.

In FIGS. 10–12, the end cap 59 is shown. The end cap 59 includes a cylinder 93 having a cylindrically shaped socket 94 for receiving bar 60. The bar 60 end portion 96 enters socket 94 by following the direction of arrow 95. Bar 60 has an outer surface 97 that is cylindrically shaped corresponding in shape to the inside surface 98 of cylinder 93. Stop plate 99 defines the innermost penetration of bar 60 into socket 94 when the end 96 of bar 60 engages stop plate 99.

In the embodiment of FIGS. 10–12, four plates 100–103 are attached to stop plate 99 as shown. The two plates 100, 101 are of the same general configuration as the plates 82, 83 of the embodiment shown in FIGS. 7–9. The plates 100, 101 thus have upper openings 106 and lower openings 107. In the embodiment of FIGS. 10–12, the plates 102, 103 are smaller than plates 100, 101. These plates 102, 103 also have openings 106.

As shown in FIG. 12, the openings 106 are of corresponding size and shape. All openings 106 have the axis 108 as a common central axis. The openings 107 have axis 109 as their common central axis. This allows a transverse pin 104 to be placed through the openings 106 and a pin 105 to be placed through the openings 107.

The construction of FIGS. 10–12 allows a sling 54 to be attached as shown in FIG. 10. The sling 54 has loops 55, 56. The loop 55 is placed in the gap 112, in between plates 100 and 102. The loop 56 is placed in the gap 113, in between plates 101 and 102. A triangular lifting plate 114 is attached to pin 105 as shown in FIG. 10. This allows a pair of shackles 115, 116 to be affixed to the triangular plate 114 as shown for slings 63, 64 to be attached to the shackles 115, 116. The plate 114 is an equilateral triangular shape having an opening that accommodates pin 105 and two other openings that accept pins 117, 118. Pins 117, 118 are shackle pins that are similar in size and shape to pin 115. Arrow 110 shows assembly of pin 104 to openings 106. Arrow 111 shows assembly of pin 105 to openings 107.

The following table lists the parts numbers and parts description as used herein and in the drawings attached hereto.

PARTS LIST

| Part Number | Description |
|---|---|
| B | building |
| D | deck |
| P | package |
| 10 | spreader bar assembly |
| 11 | center bar |
| 12 | end |
| 13 | end |
| 14 | hollow bore |
| 15 | cylindrical wall |
| 16 | outer surface |
| 17 | inner surface |
| 18 | end cap |
| 19 | cylindrical wall |
| 19A | cylindrical wall |
| 20 | outer surface |
| 21 | inner bore |
| 22 | inner surface |
| 23 | transverse wall |
| 24 | open end |
| 25 | outer surface |
| 26 | inner surface |
| 27 | plate |
| 28 | plate |
| 29 | transverse pin |
| 30 | transverse pin |
| 31 | transverse pin |
| 32 | retainer plate |
| 33 | retainer plate |

-continued

PARTS LIST

| Part Number | Description |
|---|---|
| 34 | sling |
| 35 | center cable |
| 36 | eye |
| 37 | eye |
| 38 | sling |
| 39 | cable section |
| 40 | eye |
| 41 | arrow |
| 42 | package |
| 43 | equipment |
| 44 | tanks |
| 45 | lifting apparatus |
| 46 | hook |
| 47 | sling |
| 48 | loop |
| 49 | loop |
| 50 | middle portion |
| 51 | fold |
| 52 | spreader bar |
| 53 | end cap |
| 54 | sling |
| 55 | loop |
| 56 | loop |
| 57 | bar section |
| 58 | spreader bar |
| 59 | end cap |
| 60 | bar section |
| 61 | spreader bar |
| 62 | spreader bar |
| 63 | sling |
| 64 | sling |
| 65 | sling |
| 66 | sling |
| 67 | end cap |
| 68 | end cap |
| 69 | bar section |
| 70 | bar section |
| 71 | sling |
| 72 | sling |
| 73 | deck fixture |
| 74 | sling |
| 75 | cylinder |
| 76 | cylindrical socket |
| 77 | arrow |
| 78 | end of bar section |
| 79 | outer surface |
| 80 | inside surface |
| 81 | stop plate |
| 82 | plate |
| 83 | plate |
| 84 | opening |
| 85 | opening |
| 86 | axis |
| 87 | axis |
| 88 | transverse pin |
| 89 | transverse pin |
| 90 | arrow |
| 91 | arrow |
| 92 | gap |
| 93 | cylinder |
| 94 | socket |
| 95 | arrow |
| 96 | end portion |
| 97 | outer surface |
| 98 | inside surface |
| 99 | stop plate |
| 100 | plate |
| 101 | plate |
| 102 | plate |
| 103 | plate |
| 104 | pin |
| 105 | pin |
| 106 | opening |

-continued

PARTS LIST

| Part Number | Description |
|---|---|
| 107 | opening |
| 108 | axis |
| 109 | axis |
| 110 | arrow |
| 111 | arrow |
| 112 | gap |
| 113 | gap |
| 114 | triangular plate |
| 115 | shackle |
| 116 | shackle |
| 117 | pin |
| 118 | pin |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A spreader bar assembly for use with a pair of lifting lines comprising:

a) an elongated integral bar of generally uniform cross-section at its ends;

b) a pair of lifting eye assemblies connected during a lifting operation to each respective end portion of the bar and forming a connection therewith, each of the lifting eye assemblies comprising:

a female socket providing an open end bore of uniform section and terminating at an inner portion of the bore, the female socket normally occupying a position abutting the end portion of the elongated support bar;

a pair of plates integral with the socket and extending rearwardly from the open end portion of said socket;

means for connecting the lifting line to a lifting eye assembly at one of the plate; and c) said means for connecting including at least three pins connected to plates including one pin that extends between respective inside surfaces of the plates and a pair of pins extending respectively from the outside surfaces of the plates.

2. The apparatus of claim 1 wherein the socket is cylindrical and provides a uniform internal cylindrical bore and further comprising a reinforcing sleeve within the socket.

3. The apparatus of claim 2 wherein said reinforcement sleeve is of a corresponding section to the elongated bar.

4. The apparatus of claim 1 wherein each of the plates is in a plane generally parallel with the axis of said elongated bar.

5. The apparatus of claim 1 wherein said elongated bar is a single integral structural member.

6. The apparatus of claim 5 wherein said elongated bar is cylindrical and each of the sockets provides a cylindrical recess correspondingly sized to receive an end of said bar thereinto.

* * * * *